US011146017B2

(12) United States Patent
Shimizu et al.

(10) Patent No.: US 11,146,017 B2
(45) Date of Patent: Oct. 12, 2021

(54) CONNECTOR

(71) Applicants: YAZAKI CORPORATION, Tokyo (JP); HONDA MOTOR CO., LTD., Tokyo (JP)

(72) Inventors: Taro Shimizu, Wako (JP); Ryosuke Ohfuku, Makinohara (JP)

(73) Assignees: YAZAKI CORPORATION, Tokyo (JP); HONDA MOTOR CO., LTD., Tokyo (JP)

( * ) Notice: Subject to any disclaimer, the term of this patent is extended or adjusted under 35 U.S.C. 154(b) by 0 days.

(21) Appl. No.: 16/893,305

(22) Filed: Jun. 4, 2020

(65) Prior Publication Data

US 2020/0388950 A1 Dec. 10, 2020

(30) Foreign Application Priority Data

Jun. 4, 2019 (JP) ..... JP2019-104556

(51) Int. Cl.
*H01R 13/506* (2006.01)
*H01R 13/639* (2006.01)

(52) U.S. Cl.
CPC ..... *H01R 13/506* (2013.01); *H01R 13/639* (2013.01)

(58) Field of Classification Search
CPC ..... H01R 13/506; H01R 13/639; H01R 13/7193; H01R 13/64; H01R 13/6465; H01R 13/502; H01R 2201/26
See application file for complete search history.

(56) References Cited

U.S. PATENT DOCUMENTS

| | | | | |
|---|---|---|---|---|
| 9,172,187 | B2 * | 10/2015 | Miyakawa | H01R 13/639 |
| 9,209,561 | B2 * | 12/2015 | Miyakawa | H01R 13/641 |
| 2005/0048843 | A1 | 3/2005 | Iida | |
| 2007/0264863 | A1 * | 11/2007 | Nakamura | H01R 13/641 439/489 |

FOREIGN PATENT DOCUMENTS

| | | | |
|---|---|---|---|
| JP | 2003-203722 | A | 7/2003 |
| JP | 2014-127318 | A | 7/2014 |
| JP | 6023580 | B2 | 11/2016 |

* cited by examiner

*Primary Examiner* — Briggitte R. Hammond
(74) *Attorney, Agent, or Firm* — Kenealy Vaidya LLP

(57) ABSTRACT

A connector includes a housing that has a L-shape in a side view and in which a connection portion capable fitting to the mating connector is projected, a terminal having a connection terminal portion and an electric wire connection portion and mounted to the housing by inserting the connection terminal portion into a terminal accommodation portion formed in the connection portion, an electric wire connected to the electric wire connection portion of the terminal and led out from the housing, a ferrite core mounted to the electric wire and accommodated in the housing. The housing includes a rib formed along an extending direction of the connection portion, and a hole portion formed at a root portion of the rib.

5 Claims, 8 Drawing Sheets

CONNECTOR

CROSS-REFERENCE TO RELATED APPLICATIONS

This application is based on and claims priority under 35 USC 119 from Japanese Patent Application No. 2019-104556 filed on Jun. 4, 2019, the contents of which are incorporated herein by reference.

TECHNICAL FIELD

The present invention relates to a connector.

BACKGROUND ART

For example, a connector on a harness side for connecting a wire harness to an inflator of an airbag system of an automobile is provided with a housing having a connection portion that is fitted and connected to a mating connector provided in the inflator (see, for example, Patent Literatures 1 and 2). The housing of the connector includes a ferrite accommodation portion covered with a cover, and a ferrite core mounted to an electric wire of the wire harness as a noise filter is accommodated in the ferrite accommodation portion.

CITATION LIST

Patent Literature

Patent Literature 1: JP-A-2003-203722
Patent Literature 2: Japanese Patent No. 6023580

SUMMARY OF INVENTION

When the inflator is activated to deploy the airbag, a large impact force is applied to the connector. Further, the housing accommodating the ferrite core is largely swung with a connection point with the mating connector as a fulcrum, which may lead to poor connection and damage to the connection point. Not only when the airbag is deployed but also when an external impact is applied to the connector, there is a possibility that the housing accommodating the ferrite core is largely swung around the connection point.

The present invention has been made in view of the above circumstances, and an object thereof is to provide a connector capable of maintaining a good connection state with a mating connector even when an external impact is applied.

In order to achieve the above object, the connector according to the present invention is characterized by the following (1) to (3).

(1) A connector connected to a mating connector, the connector including:

a housing having an L shape in a side view in which a connection portion fittable to the mating connector is projected:

a terminal that includes a connection terminal portion and an electric wire connection portion, and that is mounted to the housing by inserting the connection terminal portion into a terminal accommodation portion formed in the connection portion;

an electric wire connected to the electric wire connection portion of the terminal and led out from the housing; and a ferrite core mounted to the electric wire and accommodated in the housing, wherein the housing includes a rib formed along an extending direction of the connection portion, and a hole portion formed at a root portion of the rib.

(2) The connector according to (1), wherein the hole portion is formed between the rib and the ferrite core.

(3) The connector according to (1), wherein the hole portion is a long hole extending along a width direction of the housing.

According to the connector having the above configuration (1), strength of the connection portion is increased by forming the rib on the connection portion. In addition, the rib formed on the connection portion can be engaged with the groove portion formed in the mating connector, so that an erroneous fitting prevention function of preventing erroneous fitting with respect to the mating connector can be provided.

When a large external impact force is applied in a state in which the connector is connected to the mating connector, the L-shaped housing accommodating the ferrite core is largely swung around the connection point with the mating connector, which may lead to poor connection or damage to the connection point.

In the connector according to the present invention, since the hole portion is provided at the root portion of the rib in the housing, a part of the housing can be provided with flexibility. Therefore, when an external impact is applied, the impact can be absorbed by a portion of the housing in which the hole portion is provided. As a result, it is possible to reduce the impact applied to the connection point with the mating connector and maintain a good connection state with the mating connector. In addition, since the hole portion is formed at the root of the rib of the connection portion, it is possible to suppress decrease in the strength of the housing due to the formation of the hole portion and to prevent the housing from being damaged when the impact is applied.

According to the connector having the above configuration (2), since the hole portion is formed between the rib of the housing and the ferrite core, the flexibility is provided between the rib and the ferrite core, so that the impact applied to the housing can be favorably absorbed when a large acceleration is applied to the heavy ferrite core.

According to the connector having the above configuration (3), since the hole portion is a long hole extending along the width direction of the housing, it is possible to provide the flexibility along the width direction of the housing and to further favorably absorb the impact.

According to the present invention, it is possible to provide a connector capable of maintaining a good connection state with the mating connector even when the external impact is applied.

The present invention has been briefly described above. Details of the present invention will be further clarified by reading a mode (hereinafter, referred to as an "embodiment") for carrying out the present invention described below with reference to the accompanying drawings.

BRIEF DESCRIPTION OF DRAWINGS

FIG. 7A is a back view, FIG. 7B is an cross-sectional view taken along a line A-A in FIG. 7A, and FIG. 7C is a front view.

DESCRIPTION OF EMBODIMENTS

Figure 1:
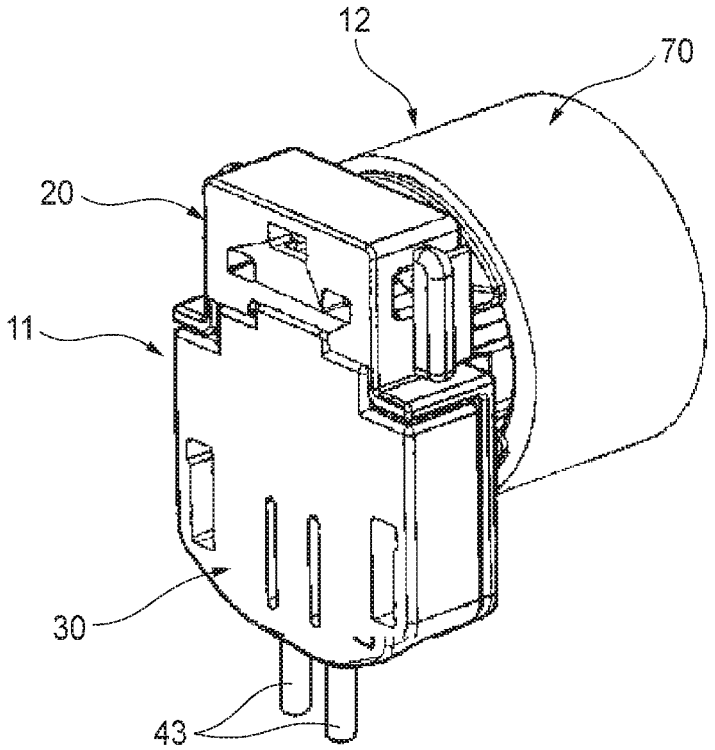
FIG. 1 is a perspective view of a connector according to an embodiment connected to a mating connector.
Figure 2:
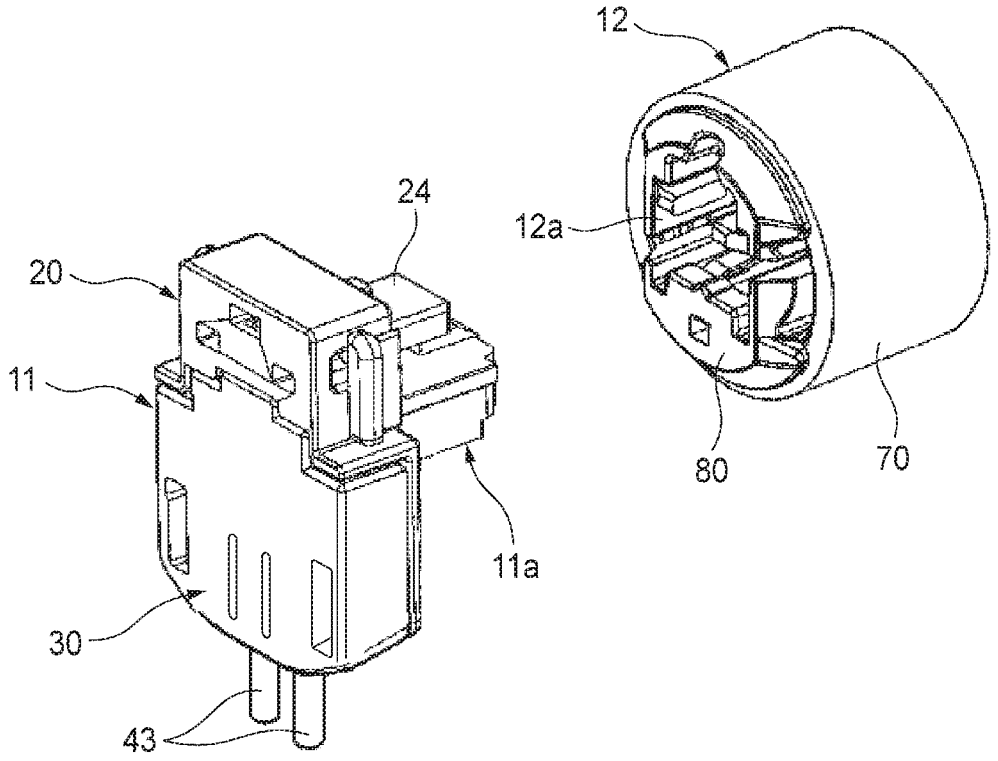
FIG. 2 is a perspective view of the connector according to the present embodiment and the mating connector as viewed from a rear side.
Figure 3:
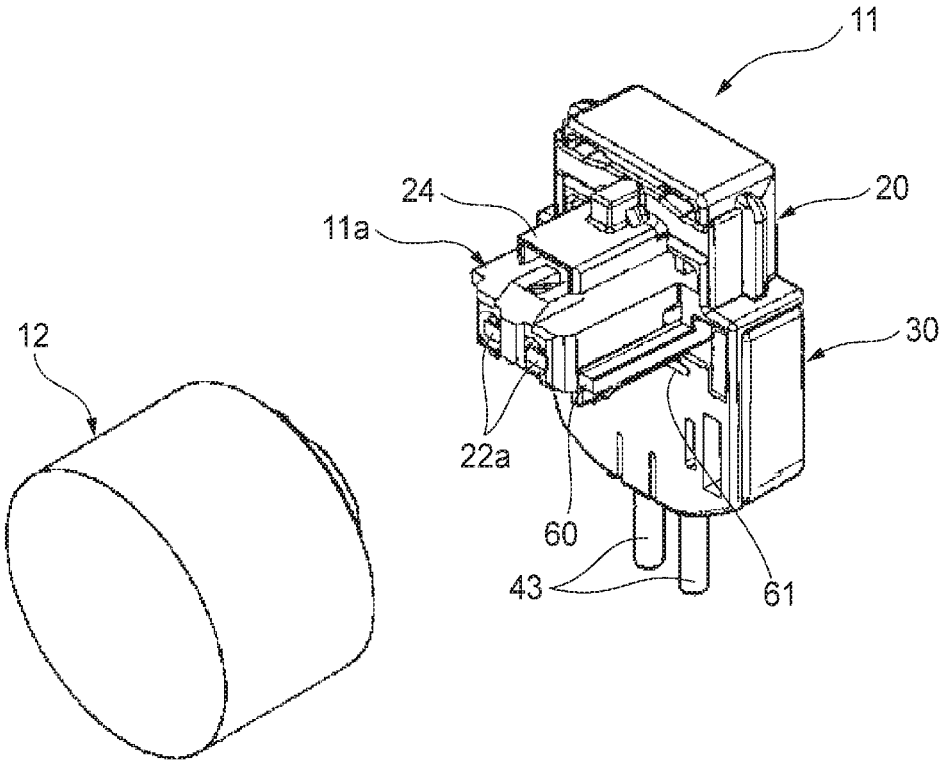
FIG. 3 is a perspective view of the connector according to the present embodiment and the mating connector as viewed from a front side.
Figure 4:
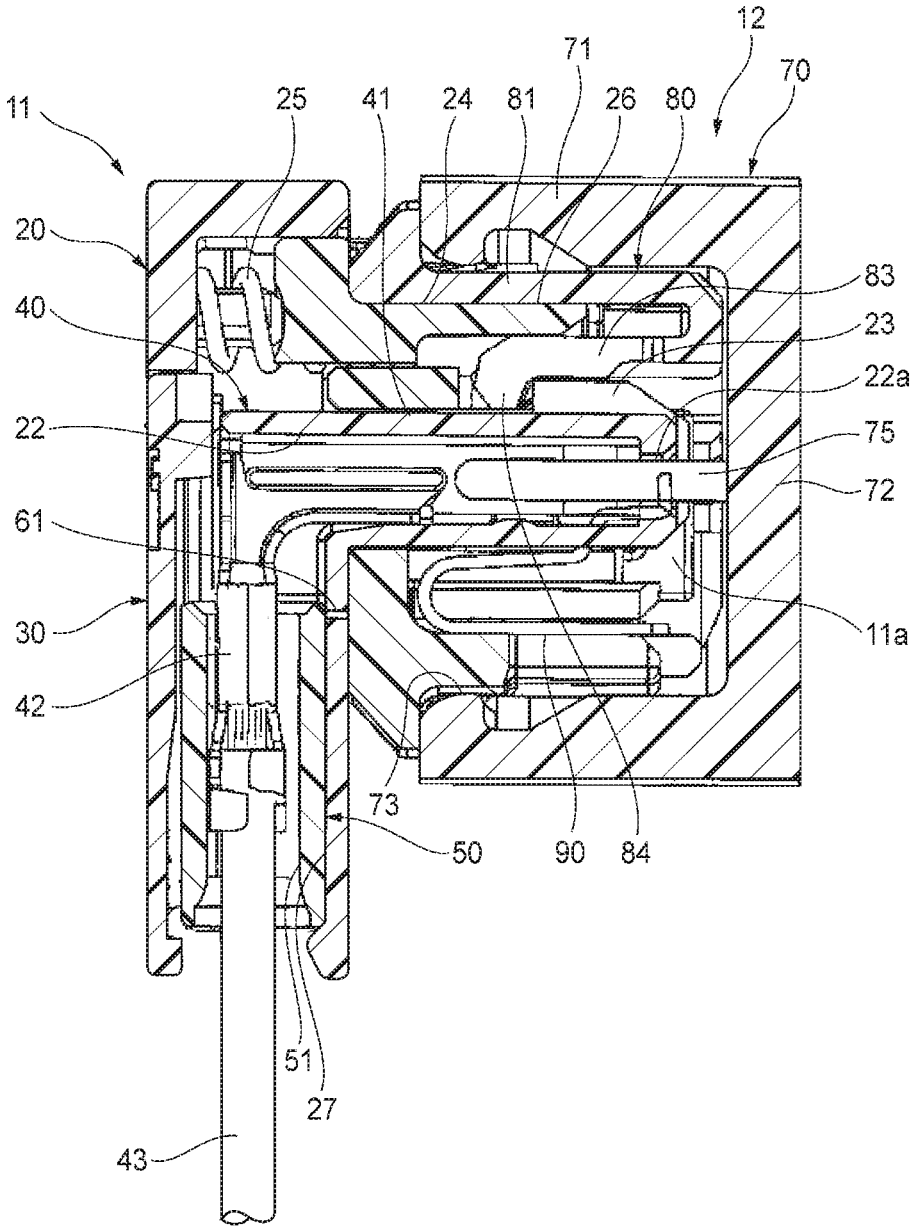
FIG. 4 is a longitudinal sectional view of the connector and the mating connector connected to each other.

Hereinafter, an embodiment of the present invention will be described with reference to the drawings. FIG. 1 is a perspective view of a connector according to the present embodiment connected to a mating connector. FIG. 2 is a perspective view of the connector according to the present embodiment and the mating connector as viewed from a rear side. FIG. 3 is a perspective view of the connector according to the present embodiment and the mating connector as viewed from a front side. FIG. 4 is a longitudinal sectional view of the connector and the mating connector connected to each other.

As shown in FIGS. 1 to 4, a connector 11 according to the present embodiment is connected to a mating connector 12. The connector 11 and the mating connector 12 form an electrical connector of an in-vehicle airbag system provided in an automobile or the like. The connector 11 is a connector on a wire harness side, and the mating connector 12 is a connector on an inflator side provided in an inflator of the airbag system.

The connector 11 has a connection portion 11*a*, and the mating connector 12 has a fitting opening 12*a*. The connector 11 is connected to the mating connector 12 by fitting the connection portion 1I a into the fitting opening 12*a* of the mating connector 12.

Figure 5:
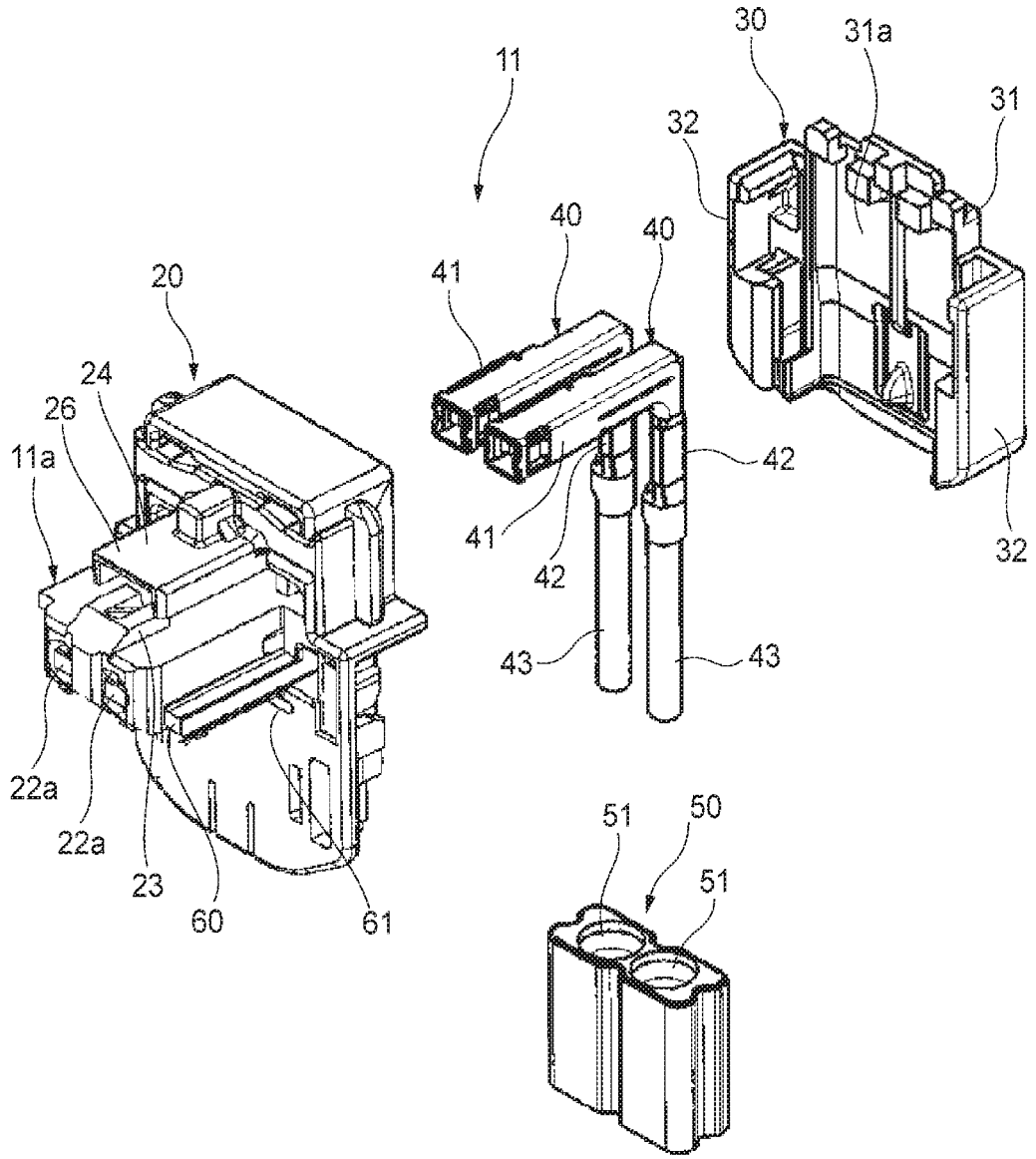
FIG. 5 is an exploded perspective view of the connector according to the present embodiment.

FIG. 5 is an exploded perspective view of the connector according to the present embodiment. As shown in FIG. 5, the connector 11 includes a housing 20, a cover 30, terminals 40, and a ferrite core 50.

The housing 20 is formed of a synthetic resin, and the connection portion 11*a* is integrally formed. The connection portion 11*a* is provided on one end side of the housing 20 so as to protrude toward a front side of the housing 20 that is a connection side with the mating connector 12. As a result, the housing 20 is formed in an L-shape in a side view. In addition, a locking protrusion 23 protruding upward is formed on an upper portion of the connection portion 11*a* on a distal end side. The housing 20 includes a slider 24. The slider 24 is provided on the upper portion of the connection portion 11*a*, and is urged toward the front side by a coil spring 25. A locking piece 26 protruding forward is formed on the slider 24.

As shown in FIG. 3, a pair of terminal accommodation chambers 22 are formed in the connection portion 11*a* of the housing 20. The terminal accommodation chambers 22 are formed along an extending direction of the connection portion 11*a*. Insertion holes 22*a* communicating with the terminal accommodation chambers 22 are formed at a distal end of the connection portion 11*a*.

A rear side of the housing 20 is opened, and the cover 30 is mounted to the opened rear side. The housing 20 has, on a rear surface thereof, a core accommodation portion 27 to which the ferrite core 50 is mounted.

The cover 30 is formed of a synthetic resin, and is mounted to the housing 20 from the rear side. The cover 30 has a plate-like portion 31 and side wall portions 32 formed on both sides of the plate-like portion 31. Each of the side wall portions 32 projects from the plate-like portion 31 toward a mounting side to the housing 20. As a result, the cover 30 is formed in a concave shape in which the mounting side to the housing 20 is concave. The cover 30 is mounted to the housing 20 so as to cover the rear surface of the housing 20 including the core accommodation portion 27.

The terminal 40 is formed of a conductive metal material, and is formed in an L shape in a side view. The terminal 40 includes connection terminal portions 41 and electric wire connection portions 42, and electric wires 43 of wire harnesses are connected to the electric wire connection portions 42. The connection terminal portions 41 of the terminals 40 are each formed in a box shape with an open distal end, and pins 75 of the mating connector 12 are inserted from distal end sides. As a result, the pin 75 and the terminal 40 are conductively connected.

The ferrite core 50 is mounted to the electric wire 43 of the wire harness. The ferrite core 50 is a component in which a ferromagnetic material of a metal oxide is formed in a block shape, and is a noise countermeasure component that prevents a noise current from flowing through the electric wire 43 due to various electromagnetic waves from the outside. The ferrite core 50 is formed in a substantially rectangular parallelepiped shape, and is formed with two insertion holes 51 along a longitudinal direction thereof. The ferrite core 50 is mounted to the electric wire 43 by passing the electric wire 43 through the insertion hole 51.

In the connector 11, the terminal 40 and the ferrite core 50 are mounted to the housing 20 from the rear side. The terminal 40 is mounted to the housing 20 by inserting the connection terminal portion 41 into the terminal accommodation chamber 22 formed in the connection portion 11*a* from the rear side of the housing 20. The ferrite core 50 is mounted to the core accommodation portion 27 of the housing 20 in a state in which the electric wire 43 is passed through the insertion hole 51.

By mounting the cover 30 to the housing 20 in a state in which the terminal 40 and the ferrite core 50 are mounted to the housing 20, the terminal 40 and the ferrite core 50 are held in the state in which the terminal 40 and the ferrite core 50 are mounted to the housing 20. Further, the electric wire 43 passed through the insertion hole 51 of the ferrite core 50 is led out from a lower end of the housing 20.

The mating connector 12 includes a holder 70 and a shunt ring 80. The holder 70 is formed in a bottomed cylindrical shape having a cylindrical portion 71 formed in a cylindrical shape and a bottom portion 72 provided on one side of the cylindrical portion 71, and a fitting side to the connector 11 is an opening portion 73. The two pins 75 are fixed to the bottom portion 72 of the holder 70 at an interval, and these pins 75 extend toward the opening portion 73 side. The pin 75 is formed of a conductive metal material, and is connected to a circuit on the inflator side of the airbag system.

The shunt ring 80 is formed of a synthetic resin. The shunt ring 80 has a main body portion 81, and the fitting opening 12*a* is formed in the main body portion 81. Further, the connection portion 11*a* of the housing 20 is fitted into the fitting opening 12*a*. In the shunt ring 80, the main body portion 81 is fitted into and mounted to the holder 70 from the opening portion 73. When the shunt ring 80 is mounted to the holder 70, the main body portion 81 is accommodated in the holder 70 so as to surround the pin 75. When the shunt ring 80 is mounted to the holder 70, the pin 75 is disposed in the fitting opening 12*a* of the main body portion 81.

The shunt ring 80 includes a lock portion 83. The lock portion 83 includes a locking claw 84 at a distal end thereof. The locking claw 84 at the distal end of the lock portion 83 locks the locking protrusion 23 formed on the connection portion 11*a* of the housing 20.

The shunt ring 80 includes a short terminal 90. The short terminal 90 is formed of a conductive metal material, and is formed in a U-shape in a side view provided with a contact point (not shown). The short terminal 90 is mounted and held in the shunt ring 80. In the mating connector 12, the contact point of the short terminal 90 is in contact with the pin 75 in a state in which the connector 11 is not fitted. As a result, the pins 75 are made conductive with each other at the short terminal 90, and the circuit on the inflator side is short-circuited. Accordingly, for example, in the circuit on the inflator side, a warning light is turned on to warn that the connector 11 is not properly fitted to the mating connector 12.

In order to fit the connector 11 to the mating connector 12, the connection portion 11*a* of the connector 11 is inserted into the fitting opening 12*a* of the mating connector 12. In this way, the pin 75 of the mating connector 12 is inserted into the insertion hole 22*a*. Accordingly, the pin 75 is inserted into the connection terminal portion 41 of the terminal 40, and the pin 75 and the terminal 40 are electrically connected.

When the connection portion 11*a* of the connector 11 is inserted into the fitting opening 12*a* of the mating connector 12, the locking claw 84 of the lock portion 83 of the shunt ring 80 locks the locking protrusion 23 formed on the connection portion 11*a* of the housing 20. This maintains a fitted state of the connector 11 and the mating connector 12. In this state, the locking piece 26 of the slider 24 urged forward of the housing 20 by the coil spring 25 enters an opposite side of the locking protrusion 23 with respect to the lock portion 83. Therefore, detachment of the locking claw 84 from the locking protrusion 23 due to elastic deformation of the lock portion 83 is prohibited. As a result, a locked state of the locking protrusion 23 by the locking claw 84 of the lock portion 83 is maintained, and the connector 11 and the mating connector 12 are maintained in a connected state.

When the connector 11 is fitted to the mating connector 12, a wall portion of the resin connection portion 11*a* enters between the pin 75 and the contact point of the short terminal 90 that are in contact with each other. As a result, the contact point of the short terminal 90 is separated from the pin 75, a conduction state between the pins 75 is released, and a short-circuit state of the circuit on the inflator side is released. Accordingly, for example, in the circuit on the inflator side, it is confirmed that the connector 11 is normally fitted to the mating connector 12 when the warning light is turned off.

Figure 6:
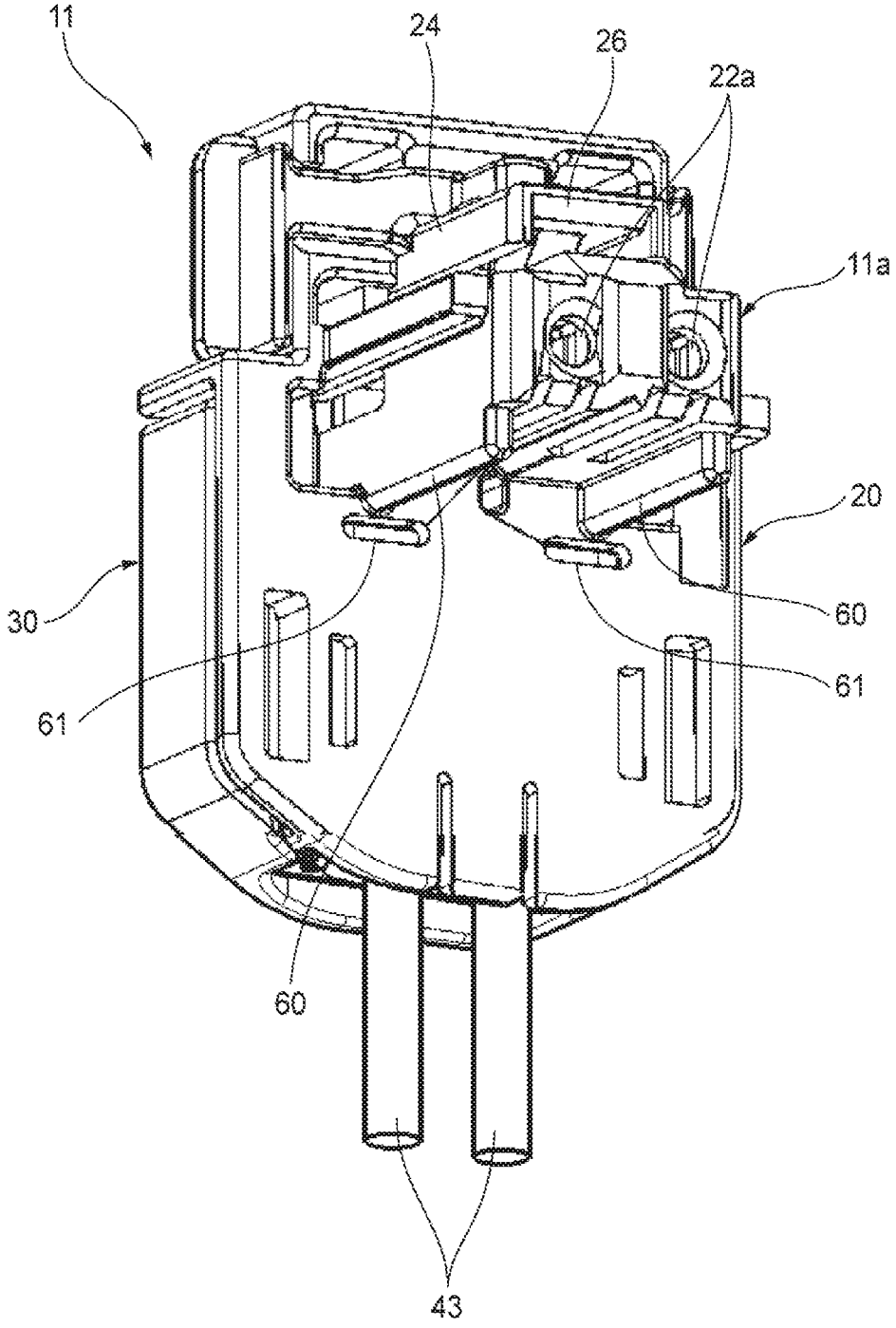
FIG. 6 is a perspective view of the connector as viewed from a front side.
Figure 7C:
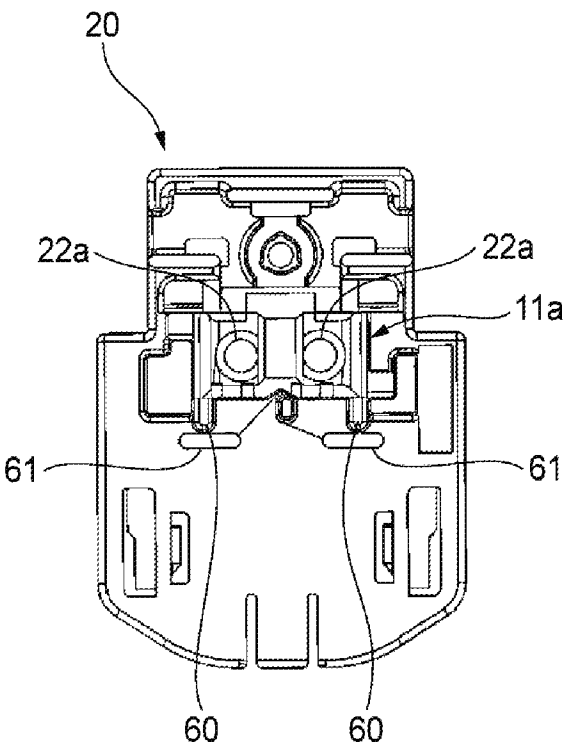
FIGS. 7A to 7C show a housing of the connector.
Figure 7B:
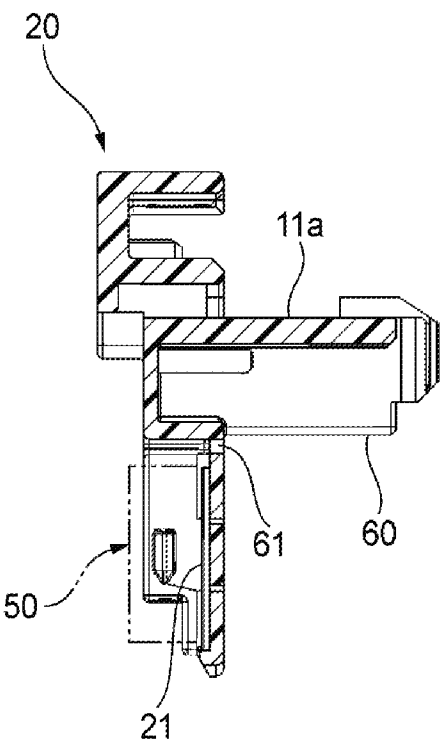
Figure 7A:
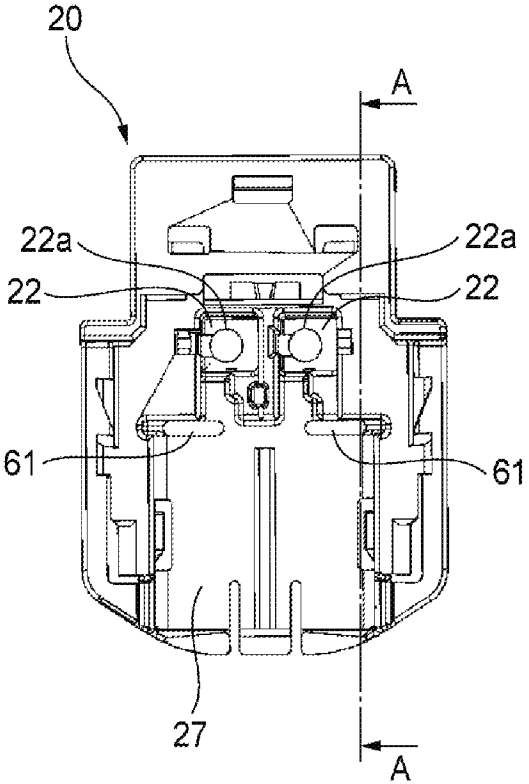

FIG. 6 is a perspective view of the connector according to the present embodiment as viewed from the front side. FIGS. 7A to 7C are views showing a housing of the connector, in which FIG. 7A is a rear view, FIG. 7B is a sectional view taken along a line A-A in FIG. 7A, and FIG. 7C is a front view.

As shown in FIG. 6 and FIGS. 7A to 7C, in the connector 11 having the above configuration, in the present embodiment, the housing 20 includes ribs 60 and hole portions 61. The pair of ribs 60 and the pair of hole portions 61 are provided.

The ribs 60 are formed integrally with the connection portion 11*a* of the housing 20. Each of the ribs 60 protrudes from both side portions of the connection portion 11*a* toward a leading-out side of the electric wire 43, and is formed along the extending direction of the connection portion 11*a*. Further, the connection portion 11*a* is reinforced by the rib 60 to increase rigidity. In addition, these ribs 60 can be engaged with groove portions 80*a* of the fitting opening 12*a* formed on the shunt ring 80 of the mating connector 12 (see FIG. 2). The connector 11 can be fitted in a direction in which the rib 60 of the connection portion 11*a* is engaged with the groove portion 80*a* of the shunt ring 80 of the mating connector 12. That is, the connector 11 and the mating connector 12 have an erroneous fitting prevention function of preventing erroneous fitting by the rib 60 of the connection portion 11*a* and the groove portion 80*a* of the shunt ring 80.

The hole portions 61 are formed at root portions of the ribs 60 in the housing 20, respectively. The hole portion 61 is formed between the rib 60 of the connection portion 11*a* and the ferrite core 50 accommodated in the core accommodation portion 27 (see FIG. 7B). In addition, each of the hole portions 61 is a through hole formed of a long hole, and each of the hole portions 61 formed of these long holes extends along a width direction of the housing 20.

Next, an assembling procedure of the connector 11 will be described.

Figure 8A:
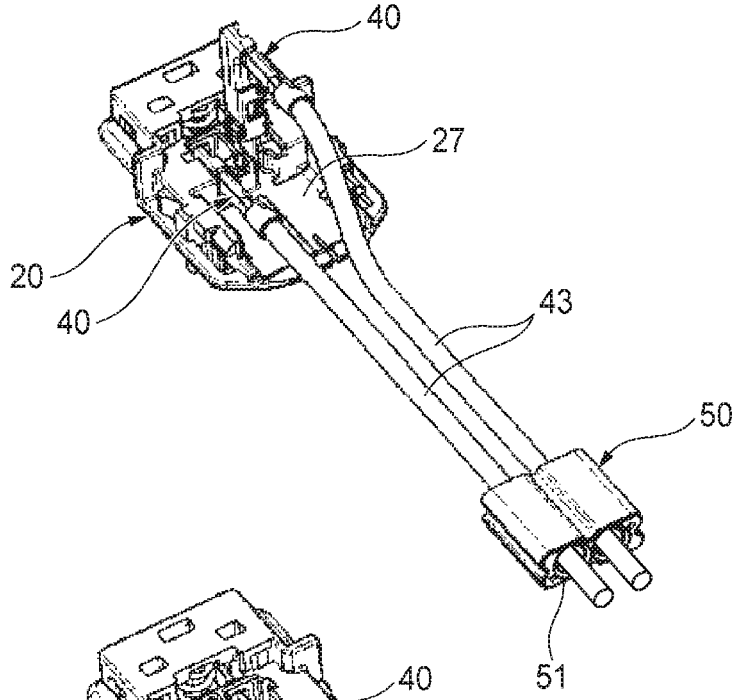
FIGS. 8A to 8C are views for explaining an assembling procedure of the connector, and perspective views of the connector during assembly.
Figure 8B:
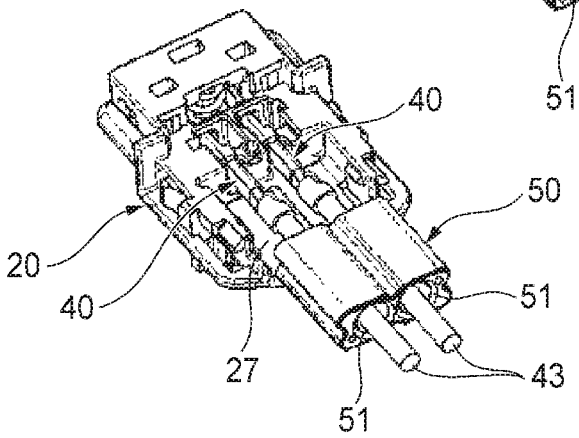
Figure 8C:
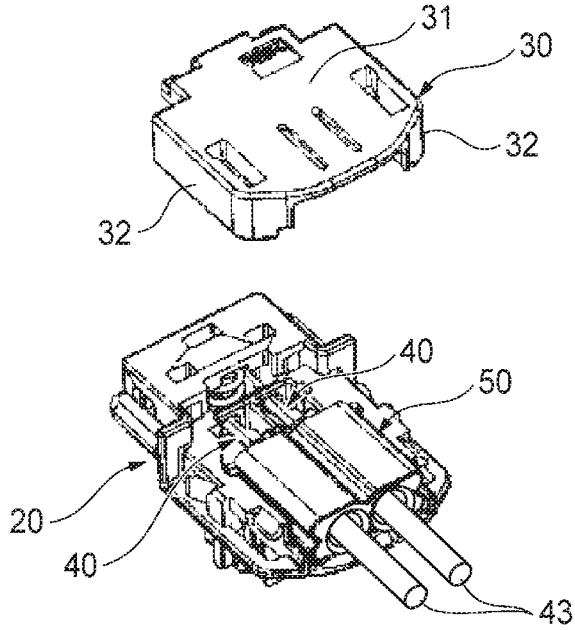

FIGS. 8A to 8C are views for explaining the assembling procedure of the connector, and are perspective views of the connector during assembly, respectively.

As shown in FIG. 8A, first, the terminal 40 is assembled to the housing 20. Specifically, the connection terminal portion 41 of the terminal 40 to which the electric wire 43 is connected is inserted into the terminal accommodation chamber 22 of the connection portion 11*a* from the rear side of the housing 20. Accordingly, the terminal 40 is mounted to the housing 20, and the electric wire 43 connected to the electric wire connection portion 42 of the terminal 40 is led out from another end side opposite to the connection portion 11*a* of the housing 20 through the core accommodation portion 27 of the housing 20.

As shown in FIG. 8B, by passing the electric wire 43 through the insertion hole 51 in advance, the ferrite core 50 mounted to the electric wire 43 is slid toward the housing 20 side and is disposed in the core accommodation portion 27.

As shown in FIG. 8C, when the terminal 40 and the ferrite core 50 are mounted to the housing 20, the cover 30 is put on and mounted to the housing 20 from the rear side. As a result, the terminal 40 and the ferrite core 50 are held in a state of being mounted to the housing 20, and the electric wire 43 passed through the insertion hole 51 of the ferrite core 50 is led out from the lower end of the housing 20.

According to the connector 11 of the present embodiment having the above structure, strength of the connection portion 11*a* is increased by forming the rib 60 on the connection portion 11*a*. In addition, the rib 60 formed on the connection portion 11*a* can be engaged with the groove portion 80*a* formed in the shunt ring 80 of the mating connector 12, so that the erroneous fitting prevention function of preventing the erroneous fitting with the mating connector 12 can be provided.

When the inflator is activated and the airbag is deployed in a state in which the connector 11 is connected to the mating connector 12, a large impact force is applied to the connector 11. Then, the L-shaped housing 20 accommodating the ferrite core 50 is largely swung around a connection point with the mating connector 12, which may lead to poor connection and damage to the connection point. For example, when the locking claw 84 of the lock portion 83 locking the locking protrusion 23 is disengaged from the locking protrusion 23 and the pin 75 is pulled out of the terminal 40, the poor connection may occur, and the connection portion 11*a* of the connector 11 and the main body portion 81 of the shunt ring 80 having the fitting opening 12*a* of the mating connector 12 may be damaged.

In the connector 11 according to the present embodiment, since the hole portion 61 is provided at the root portion of the rib 60 in the housing 20, a part of the housing 20 can be provided with flexibility. Therefore, when the impact at the time of deployment of the airbag is applied, the impact can be absorbed by a portion of the housing 20 in which the hole portion 61 is provided. Accordingly, it is possible to reduce the impact applied to the connection point with the mating connector 12 and maintain a good connection state with the mating connector 12. In addition, since the hole portion 61 is formed at the root of the rib 60 of the connection portion 11*a*, it is possible to suppress decrease in the strength of the housing 20 due to the formation of the hole portion 61 and to prevent the housing 20 from being damaged when the impact is applied.

Since the hole portion 61 is formed between the rib 60 of the housing 20 and the ferrite core 50, the flexibility is provided between the rib 60 and the ferrite core 50, so that the impact applied to the housing 20 can be favorably absorbed when a large acceleration is applied to the heavy ferrite core 50.

Moreover, since the hole portion 61 is a long hole extending along the width direction of the housing 20, it is possible to provide the flexibility along the width direction of the housing 20 and to further favorably absorb the impact.

The present invention is not limited to the embodiment described above, and modifications, improvements, or the like can be made as appropriate. In addition, materials, shapes, dimensions, numbers, arrangement positions or the like of elements in the embodiment described above are optional and not limited as long as the present invention can be achieved.

For example, in the present embodiment, the connector 11 connected to the mating connector 12 provided on the inflator of the airbag system is exemplified, but the connector 11 is not limited to the one connected to the mating connector 12 provided on the inflator.

The characteristics of the embodiment of the connector according to the present invention will be briefly summarized in the following [1] to [3], respectively.

[1] A connector (11) connected to a mating connector (12), the connector including:

a housing (20) having an L shape in a side view in which a connection portion (la) fittable to the mating connector (12) is projected;

a terminal (40) including a connection terminal portion (41) and an electric wire connection portion (42), and mounted to the housing (20) by inserting the connection terminal portion (41) into a terminal accommodation portion (22) formed in the connection portion (11*a*):

an electric wire (43) connected to the electric wire connection portion (42) of the terminal (40) and led out from the housing (20); and a ferrite core (50) mounted to the electric wire (43) and accommodated in the housing (20), wherein the housing (20) includes a rib (60) formed along an extending direction of the connection portion (1*a*), and a hole portion (61) formed at a root portion of the rib (60).

[2] The connector according to [1], wherein the hole portion (61) is formed between the rib (60) and the ferrite core (50).

[3] The connector according to [1], wherein the hole portion (61) is a long hole extending along a width direction of the housing (20).

What is claimed is:

1. A connector connected to a mating connector, the connector comprising:

a housing that has a L-shape in a side view and in which a connection portion capable fitting to the mating connector is projected;

a terminal that includes a connection terminal portion and an electric wire connection portion, and that is mounted to the housing by inserting the connection terminal portion into a terminal accommodation portion formed in the connection portion;

an electric wire that is connected to the electric wire connection portion of the terminal and that is led out from the housing; and a ferrite core that is mounted to the electric wire and accommodated in the housing, wherein the housing includes, a rib formed along an extending direction of the connection portion, and a hole portion formed at a root portion of the rib, and the hole portion is a through hole.

2. The connector according to claim 1, wherein the hole portion is formed between the rib and the ferrite core.

3. The connector according to claim 1, wherein the hole portion is a long hole extending along a width direction of the housing.

4. The connector according to claim 2, wherein the hole portion is a long hole extending along a width direction of the housing.

5. The connector according to claim 1, wherein a pair of hole portions are formed at the root portion of the rib, the pair of hole portions are spaced away from each other in a width direction, and the pair of hole portions are formed between the rib and the ferrite core.

* * * * *